US007614914B2

(12) United States Patent
Besana et al.

(10) Patent No.: US 7,614,914 B2
(45) Date of Patent: Nov. 10, 2009

(54) CONNECTION DEVICE FOR LOW-VOLTAGE SWITCHES

(75) Inventors: Stefano Besana, Terno d'Isola (IT); Michele Ferrari, Bergamo (IT)

(73) Assignee: ABB S.p.A., Milan (IT)

( * ) Notice: Subject to any disclaimer, the term of this patent is extended or adjusted under 35 U.S.C. 154(b) by 42 days.

(21) Appl. No.: 11/914,126

(22) PCT Filed: May 3, 2006

(86) PCT No.: PCT/EP2006/062027

§ 371 (c)(1),
(2), (4) Date: Nov. 9, 2007

(87) PCT Pub. No.: WO2006/120150

PCT Pub. Date: Nov. 16, 2006

(65) Prior Publication Data

US 2008/0089049 A1 Apr. 17, 2008

(30) Foreign Application Priority Data

May 13, 2005 (IT) ..... BG2005A0023

(51) Int. Cl.
*H01R 13/68* (2006.01)

(52) U.S. Cl. ..... 439/620.26

(58) Field of Classification Search ..... 439/76.2, 439/709, 76.1; 361/728, 729, 736; 174/50
See application file for complete search history.

(56) References Cited

U.S. PATENT DOCUMENTS

| | | | | |
|---|---|---|---|---|
| 5,923,526 | A | 7/1999 | Kangas | |
| 6,147,877 | A | 11/2000 | Strandberg et al. | |
| 6,597,578 | B2 * | 7/2003 | Shiina et al. | 361/728 |
| 6,991,496 | B2 * | 1/2006 | Kuribayashi et al. | 439/620.04 |
| 7,442,052 | B2 * | 10/2008 | Kinoshita et al. | 439/76.2 |

* cited by examiner

*Primary Examiner*—Jean F Duverne
(74) *Attorney, Agent, or Firm*—Connolly Bove Lodge & Hutz LLP

(57) ABSTRACT

The present invention relates to a connection device for low-voltage switches (1), which is particularly suited for low-voltage automatic switches both in the fixed version and in the withdrawable version. The device comprises a first terminal board (10) positioned on a corresponding switch (1) and comprising a plurality of terminals for electrical connection to one or more devices or accessories inside the switch and one or more cable clamps (20) for connection between said terminals and one or more corresponding connection cables. The cable clamp (20) comprises a shaped body (201) having a first end (202) shaped to couple mechanically and electrically with the first terminal board (10). Said shaped body (201) has a first opening (203) for insertion of a first connection cable and comprises conductive means (204) positioned inside for electrical connection between the terminals of the terminal board (10) and a corresponding connection cable.

20 Claims, 11 Drawing Sheets

CONNECTION DEVICE FOR LOW-VOLTAGE SWITCHES

RELATED APPLICATIONS

This application is a national stage application (under 35 U.S.C. § 371) of PCT/EP2006/062027 filed May 3, 2006, which claims benefit of Italian application BG2005A000023 filed May 13, 2005, disclosure of which is incorporated herein by reference.

The present invention relates to a connection device for low-voltage switches that is particularly suited to low-voltage automatic switches and disconnectors both in the fixed version and in the withdrawable version.

Low-voltage switches are normally pre-arranged for housing various types of accessories that improve or extend their functionality. Said accessories are usually interfaced with internal parts of the switch or of the control, for example to receive and make available information on the state of the switch itself; other types of accessories, such as for example the actuators, enable transformation of the signal coming from the relay or from outside, into commands for opening, contact-breaking, or closing of the switch itself.

The accessories of switches are normally connected to the outside world with three main levels of flow:

1) Supply (the typical case of accessories of an active type, such as solenoids, actuators, etc.);
2) Transmission of signals to the outside world;
3) Reception of commands or signals from the outside world.

It is therefore evident that, above all in the presence of numerous accessories, increasingly complex wiring operations become necessary, which are further complicated by the fact that switches can be installed either in a fixed configuration or in a withdrawable configuration.

To overcome the above drawback, different wiring systems have been developed that are specific for apparatuses of a fixed type or for apparatuses of a withdrawable type. The simplest solutions envisage that the cables simply come out of areas provided on the switch, whereas more advanced solutions envisage the use of connectors of the socket-plug type that enable connection of the accessories to devices of an external type, thus providing one or more of the levels of flow referred to previously.

In switches of a fixed type, the typical lack of space and the different location of the accessories result in the positioning of specific terminal boards in areas located in different points of the switch, whereas in ones of a withdrawable type the greater availability of space enables use of terminal boards of a more advanced type that concentrate the connections of the various accessories.

This further complicates the problem of wiring and of connections of the accessories in so far as the accessories must in practice be provided with wiring devices of a different type according not only to the type of switch, but also to the configuration, namely whether fixed or withdrawable, in which it is installed.

Furthermore, in the case where it is desired to convert a fixed switch into a withdrawable one, it is necessary to readapt the connections of the accessories to the new configuration, for instance by providing the cables with appropriate plugs or replacing the plugs used with the fixed switch with different plugs suited to the terminal board of the withdrawable switch. Normally in fact, the terminal board or boards of fixed switches is/are different from that/those of withdrawable ones.

This constitutes a further drawback in so far as, for each accessory, two: wiring systems of a distinct type must be envisaged, one dedicated for use on switches of a fixed type, and the other dedicated for use on switches of a withdrawable type, with consequent increase in the costs.

It is evident from the above description that there exists in the state of the art the need to have available technical solutions that will represent a valid alternative to the connection devices of the accessories for automatic switches of a known type.

The primary task of the present invention is to provide a connection device, particularly for low-voltage switches, which will enable the drawbacks referred to previously to be overcome, thus simplifying installation of the various accessories.

In the framework of this task, one of the purposes of the present invention is to provide a connection device, particularly for low-voltage switches, which will be compatible and usable both with switches in the fixed version and with ones in the withdrawable version.

A further purpose of the present invention is to provide a connection device, particularly for low-voltage automatic switches, which, as compared to the systems of a known type, will enable a considerable simplification of the passage from a switch with fixed configuration to one withdrawable configuration.

Another purpose of the present invention is to provide a connection device, particularly for low-voltage switches, which will enable a reduction in the number of components necessary for the wiring.

Not the least important purpose of the present invention is to provide a connection device for low-voltage switches, as well as a switch that comprises said device, which will present a high reliability, will be easy to manufacture, and will have competitive costs.

The above task and the above purposes, as well as others that will emerge more clearly from what follows, are achieved by a connection device for low-voltage switches according to what is specified in Claim 1.

Thanks to its innovative structure, the connection device according to the invention renders possible connection to the different accessories of the switch in a simplified way and without any need to resort to complicated wiring systems. In addition, thanks to some of its peculiarities it renders extremely easy transition from a switch in the fixed version to one in the withdrawable version, using the same cable clamps.

Further characteristics and advantages will emerge more clearly from the description of preferred but non-exclusive embodiments of a low-voltage switch according to the invention, illustrated by way of indicative and non-limiting example with the aid of the attached plate of drawings, in which.

With reference to the attached figures, the connection device for low-voltage switches 1, according to the invention, comprises a first terminal board 10 positioned on said switch 1; the terminal board 10 comprises a plurality of terminals (not illustrated) for electrical connection to one or more devices or accessories located inside said switch 1. The device according to the invention moreover comprises one or more cable clamps 20 for connection between said terminals and one or more corresponding connection cables.

Figure 1:
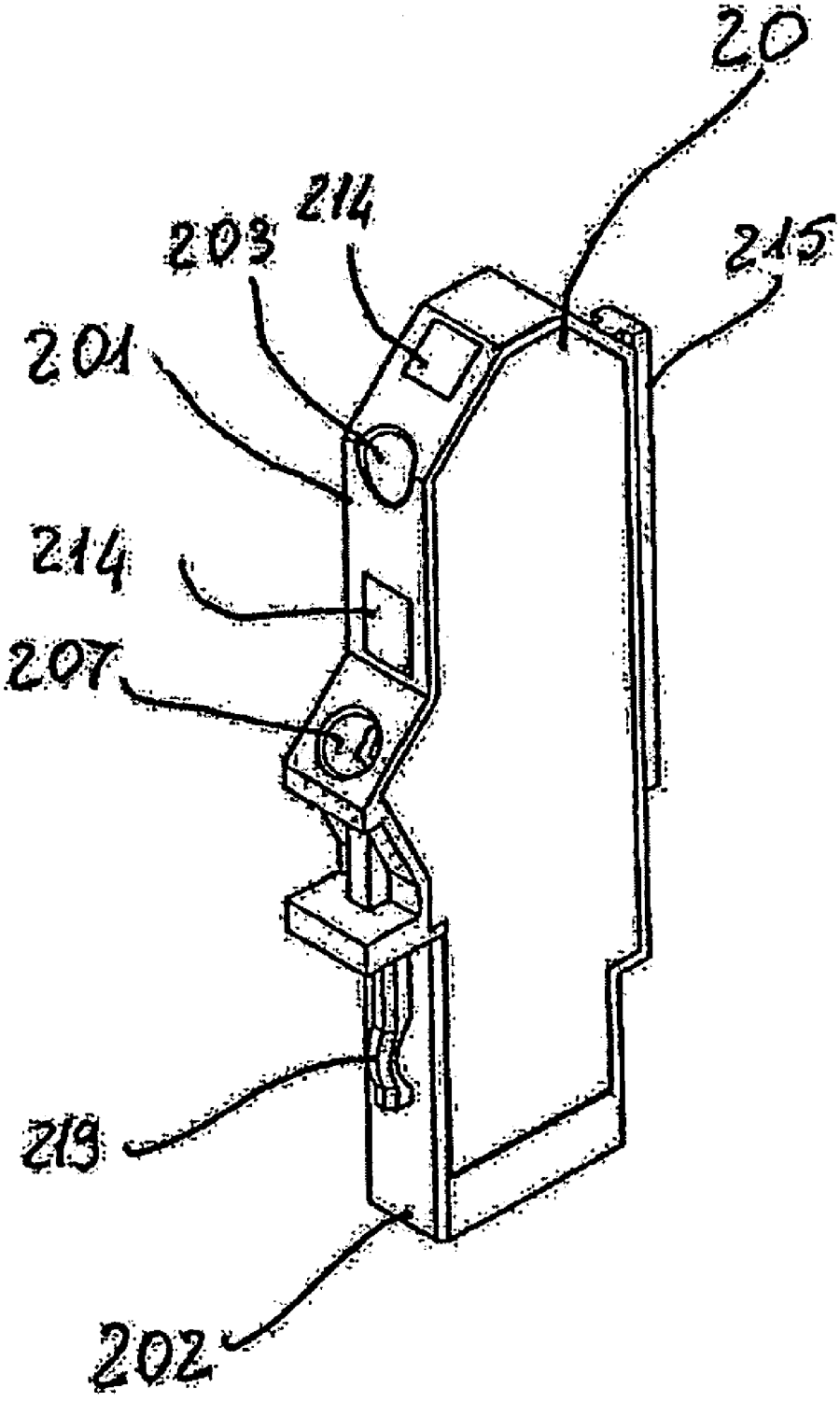
FIG. 1 is a perspective view of an embodiment of a cable clamp usable in the connection device according to the invention.
Figure 2:
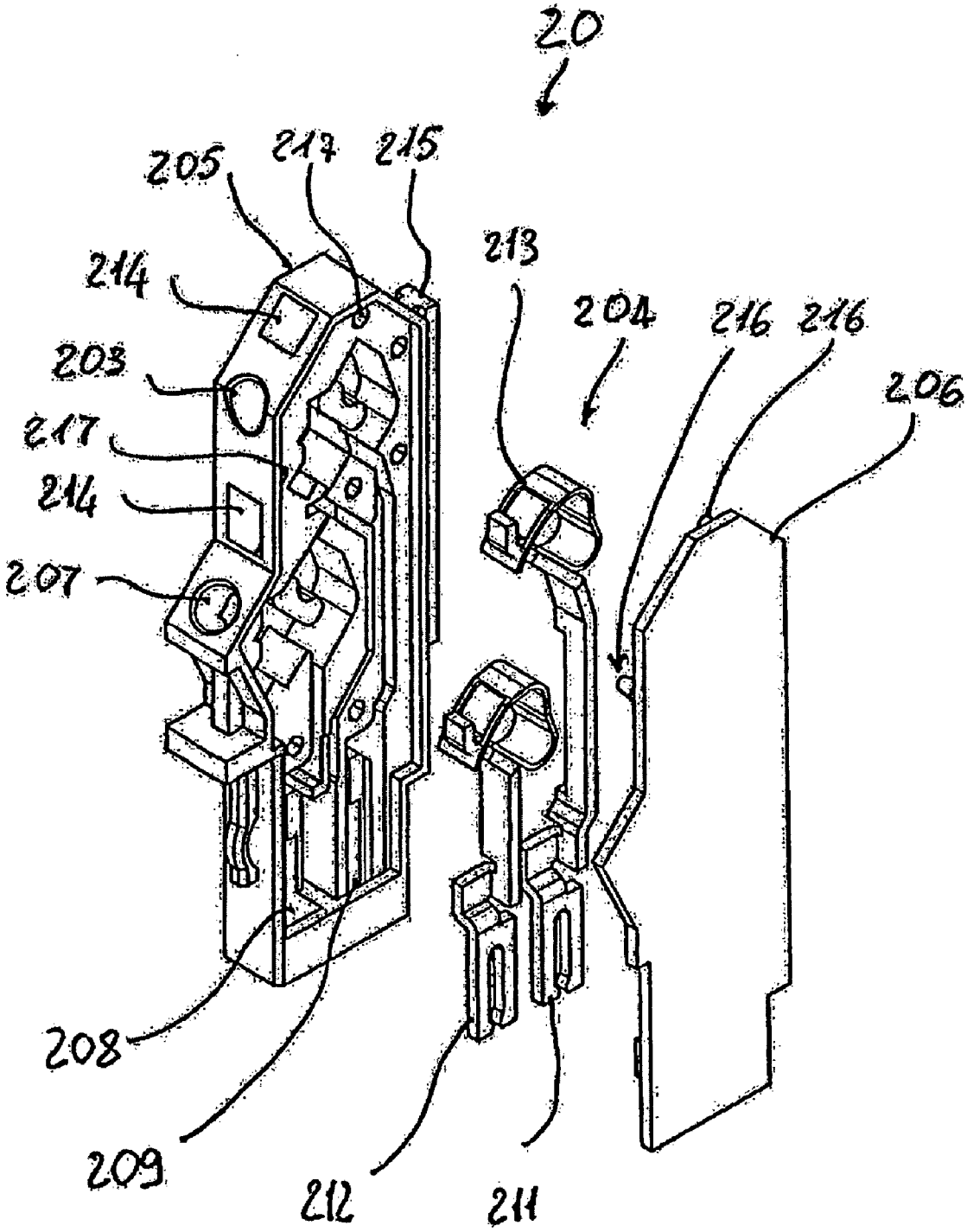
FIG. 2 is an exploded view of the cable clamp illustrated in FIG. 1.

In particular, with reference to FIGS. 1 and 2, said cable clamp 20 comprises a shaped body 201 having a first end 202 shaped to couple mechanically and electrically with the first terminal board 10. Said shaped body 201 moreover has at least one first opening 203 for insertion of a first connection cable. Positioned within the shaped body 201 are conductive means 204 for electrical connection between the terminals of said terminal board 10 and said connection cable (not illustrated).

According to a preferred embodiment, the shaped body 201 of the cable clamp 20 comprises two half-shells 205 and 206 that are geometrically conjugate or complementary and are provided, with reciprocal mechanical cowling means, for instance one or more pins 216 designed to engage in corresponding holes 217.

In addition, the shaped body 201 can have a second opening 207, or further openings, for the insertion of a second connection cable or additional connection cables and, in a position corresponding to the first end 202, can have a third opening 208 and a fourth opening 209, which are conveniently used to provide a plug-in coupling for a first terminal and a second terminal of said first terminal board 10.

Located within the shaped body 201 are conductive means 204 for electrical connection between the terminals of the terminal board 10 and a connection cable. In the example illustrated in FIGS. 1 and 2, the conductive means 204 comprise first conductive means 211, which are used for connection between a first terminal of the terminal board 10 and a first cable, and second conductive means 212, which are used for connection between a second terminal of the terminal board 10 and a second cable. Advantageously, in the embodiment: illustrated, the first half-shell 206 has inside a series of ribbings that facilitate positioning of the first and second conductive means 211, 212, at: the same time enabling mutual electrical insulation between said first and second conductive means.

Preferably, the connection device according to the invention moreover comprises means for clamping and release of said connection cables, which in the example illustrated are constituted by the elastic ends 213 of the conductive means 211 and 212. In this case, it is preferable for one or more holes 214 to be provided in the shaped body 201 so as to guarantee access by an operator to said elastic means 213 for clamping and release.

Figure 3:
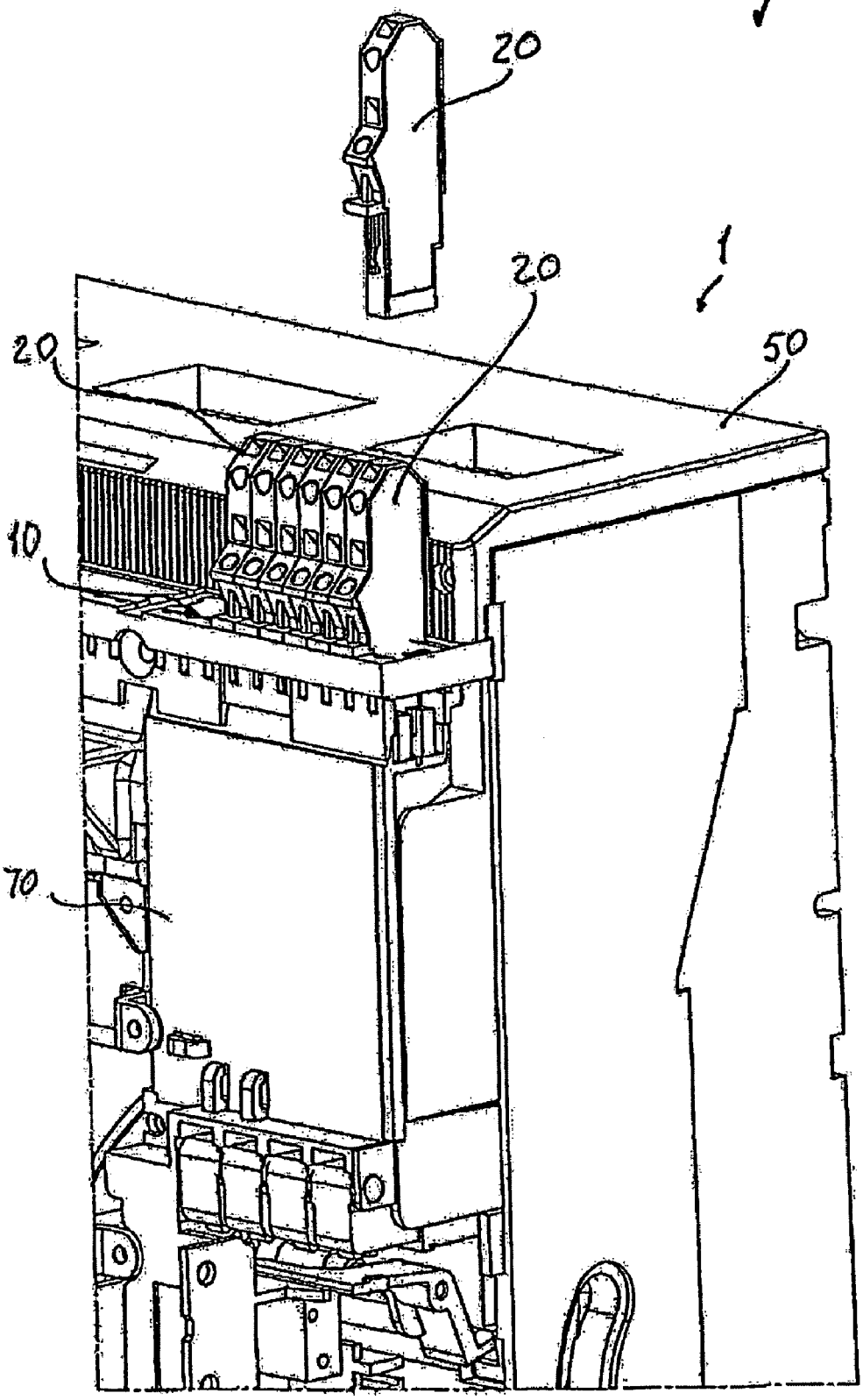
FIG. 3 is a partial perspective view of a low-voltage switch in the fixed version equipped with an example of a connection device according to the invention in the installation stage.
Figure 4:
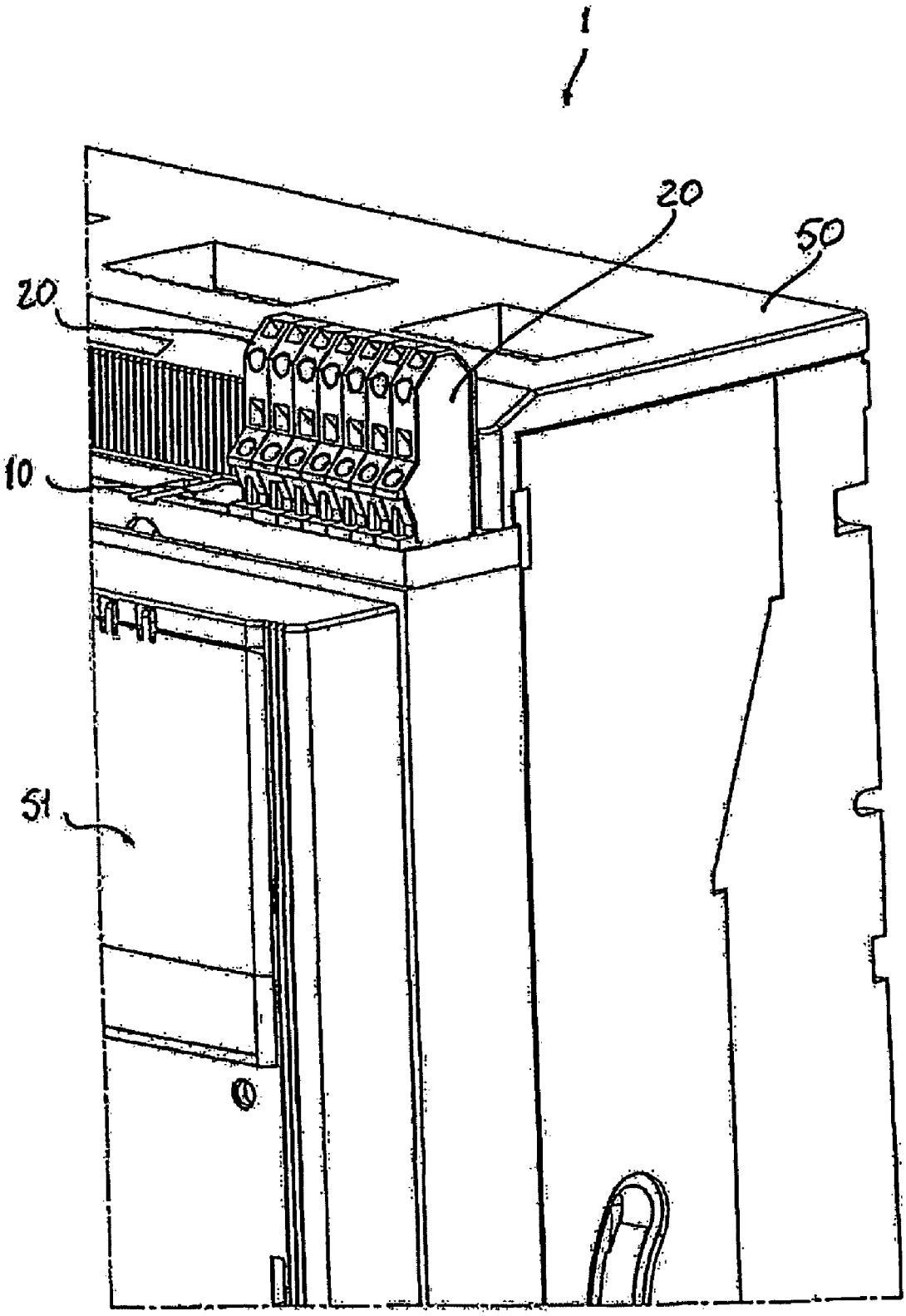
FIG. 4 is a partial perspective view of the switch illustrated in FIG. 3 once installation of a connection device according to the invention has been completed.

With reference to FIGS. 3 and 4, a low-voltage switch provided with a connection device according to the invention is now illustrated. Low-voltage switches equipped with a particular connection device constitute a further aspect of the present invention. The switch illustrated in FIGS. 3 and 4 is a switch in the fixed version, but the present invention is applicable also to switches in the withdrawable version, as illustrated hereinafter.

The switch 1 according to the invention comprises a body 50, inside which one or more fixed contacts and corresponding mobile contacts, control members, and one or more kinematic means are housed. In an appropriate position of the switch, for example in a position corresponding to its front part a terminal board 10 is located. The terminals of said terminal board are connected, through a wiring system, to one or more devices or accessories positioned within the body 50 of the switch 1.

According to a particularly preferred embodiment, the switch 1 according to the invention comprises a device for housing and connection of accessories 70 that is positioned within said body 50. This device 70, which forms the subject of a co-pending patent application (incorporated herein for reference) in the name of the present applicant, is electrically connected to said first terminal board 10 and comprises a bus with integrated connection wiring. Using the device 70 it is then possible to house the various accessories within the body 50 of the switch in an easy and optimal way. At the same time, the various connections are sent back to the same point constituted by the terminal board 10, thus simplifying considerably the wiring and the connections with the outside world.

Connection of the terminals of the terminal board 10 to the cable, clamps 20 is made in a very simple way in so far as, as mentioned previously, the end 202 of the cable clamps 20 is shaped so as to couple mechanically and electrically with said first terminal board 10. In practice, the cable clamp 20 is simply slid into the terminal board 10, rendering accessible, on the outside, via the openings 203 and 207 and the conductive means 211 and 212, connection to the terminals of the terminal board 10 and hence to the accessories and devices housed inside the body of the switch. In order to improve the mechanical coupling with the body 50 of the switch, the cable clamps 20 can be conveniently equipped with means for mechanical coupling, constituted for example by the ribbings 215 and/or 219 to be inserted in grooves provided on the body 50 of the switch Once the cover 51 has been applied, only the top part of the cable clamps remains visible and accessible, where the openings 203 and 207 for insertion of the cables and the holes 214 for access to the means for clamping and release of said cables are present.

With reference to FIGS. 5-11, according to a particular embodiment of the device of the present invention, to be used in the case where it is desired to provide a switch in the withdrawable version, the device according to the invention comprises first means 30 and second means 40 of interposition between said first terminal board 10 of said switch 1 and said one or more cable clamps 20.

Figure 5:
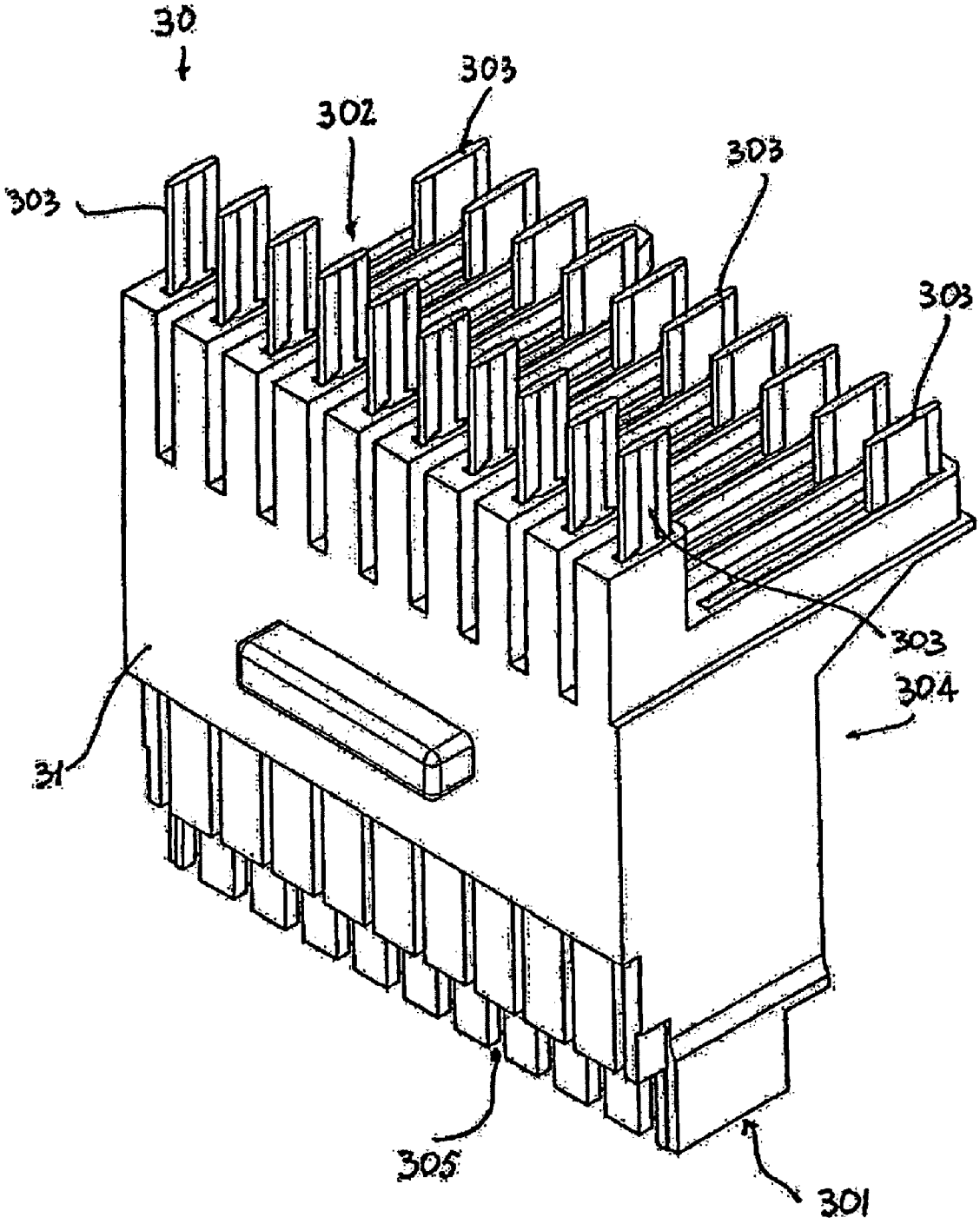
FIG. 5 is a perspective view of a first detail of a connection device according to the invention.
Figure 7:
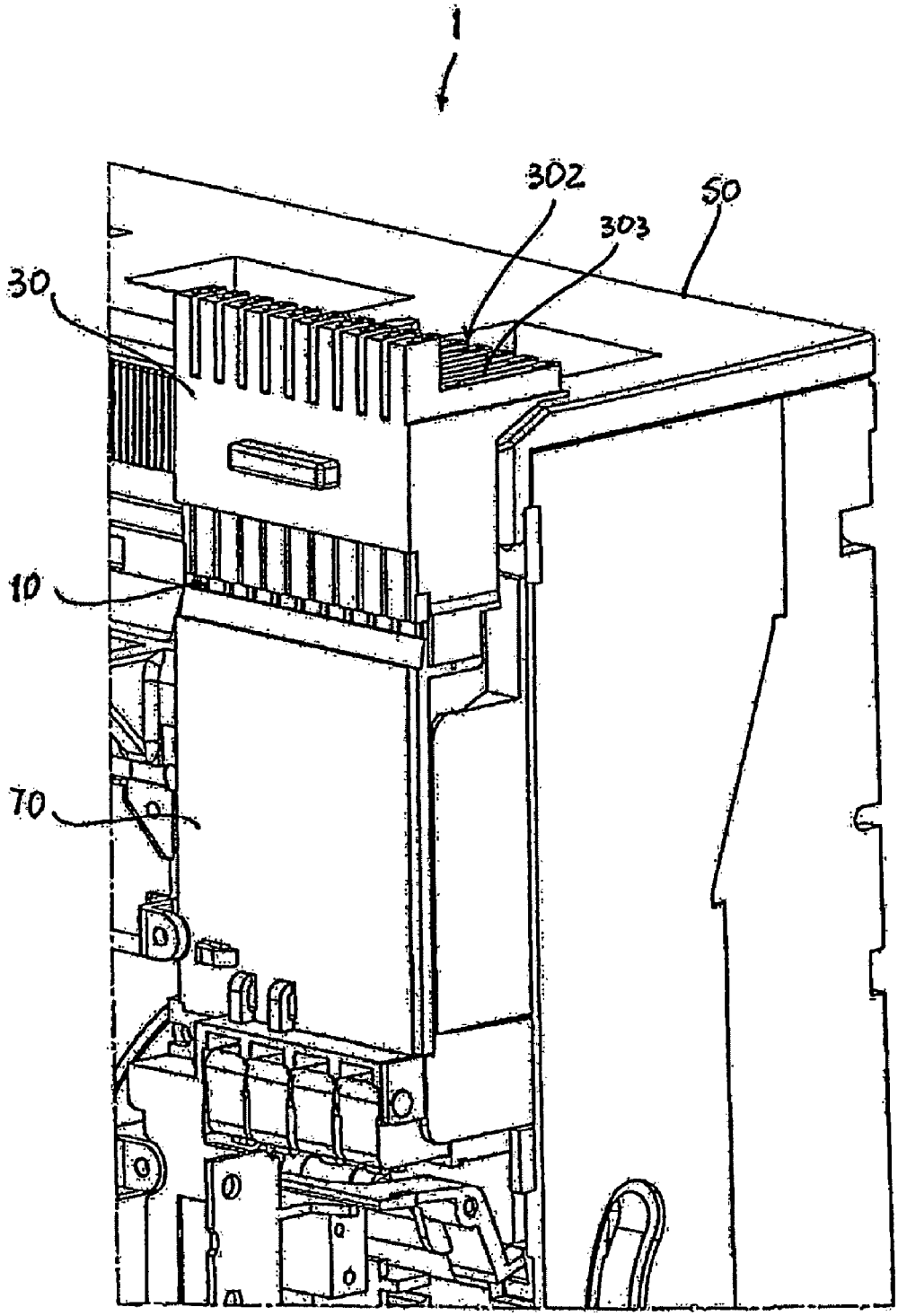
FIG. 7 is a partial perspective view of a low-voltage switch in the withdrawable version, which illustrates a first step of installation of an example of a connection device according to the invention.
Figure 8:
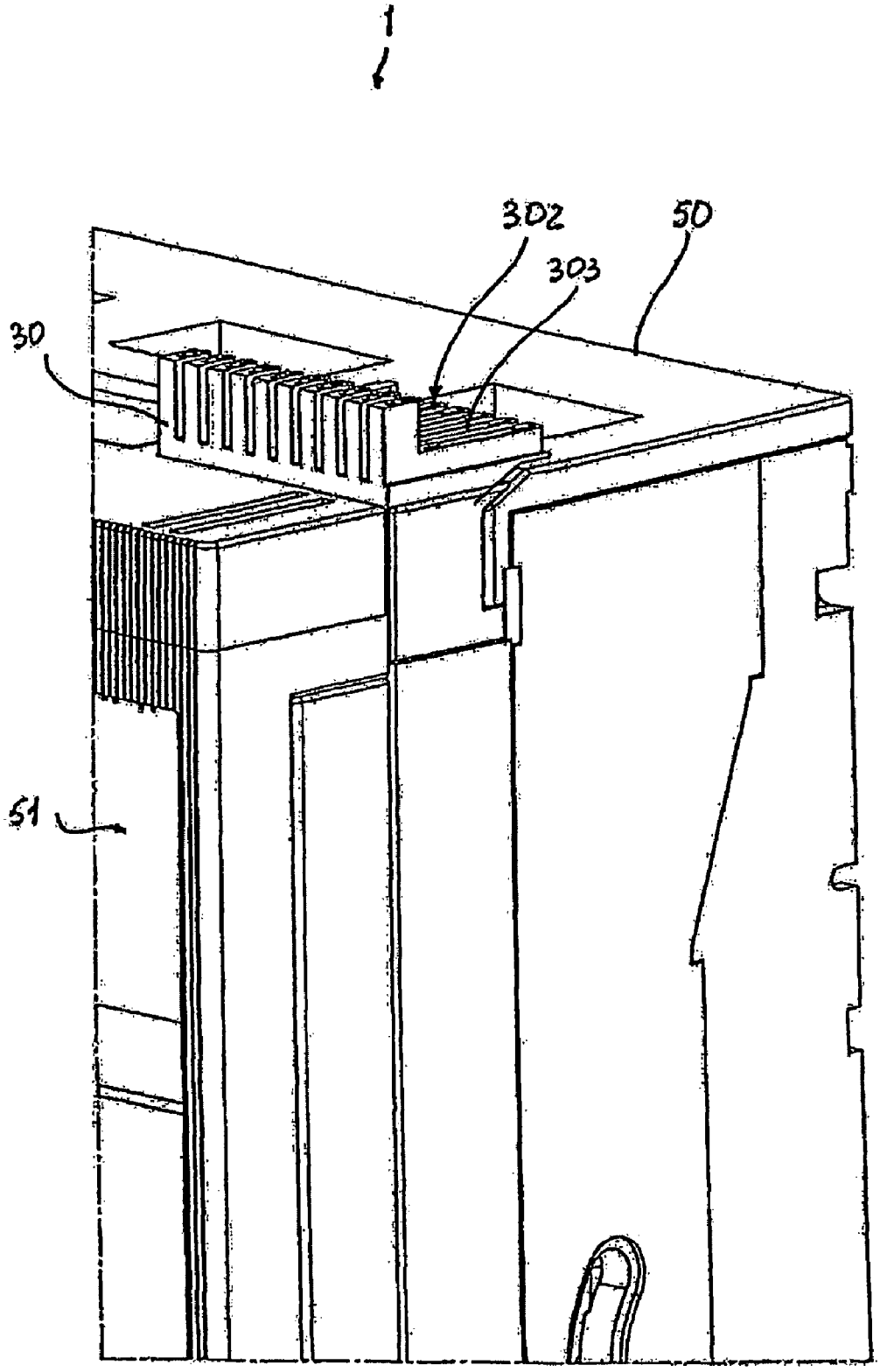
FIG. 8 is a partial perspective view of the switch: illustrated in FIG., 7 during a second step of installation of an example of a connection device according to the invention.

In particular, with reference to FIGS. 5, 7 and 8, the first means of interposition 30 are designed for coupling with the body of the switch and comprise a body 31 having a first surface 301 shaped to mate geometrically with said first terminal board 10. The first surface 301 is preferably provided with first contact means 305 for electrical connection to the terminals of said first terminal board 10, and a second surface 302, on which are set second contact means 303 electrically connected to said first contact means.

The first contact means 305 are preferably made so that the electrical, connection between them and the terminals of the terminal board 10 is made by plugging-in, i.e., in a way similar to what is described for plugging-in of the cable clamps 20. In practice, at least one portion of the first surface 301 and the corresponding contact means 305 are inserted into the terminal board, providing a geometrical and electrical coupling between the terminal board 10 itself and the first means of interposition 30.

The second surface 302 is preferably not planar and has a plurality of grooves. Said second surface 302 comprises a plurality of contact elements 303, which extend therefrom, aligned in two rows, on two different planes.

Preferably, said first means of interposition 30 comprise at least one third surface 304 for coupling with said switch 1 so as to improve the mechanical stability of the ensemble.

With reference to FIG. 8, once the cover 51 has been applied, just the top part of the second surface 302 remains visible and accessible, on which the second (before they were not called "second") contact means 303 are set. In this way, via said first means of interposition 30, the connection to the terminals of the terminal board 10, and hence to the accessories and the devices housed inside the body of the switch, is rendered accessible from outside.

Figure 6:
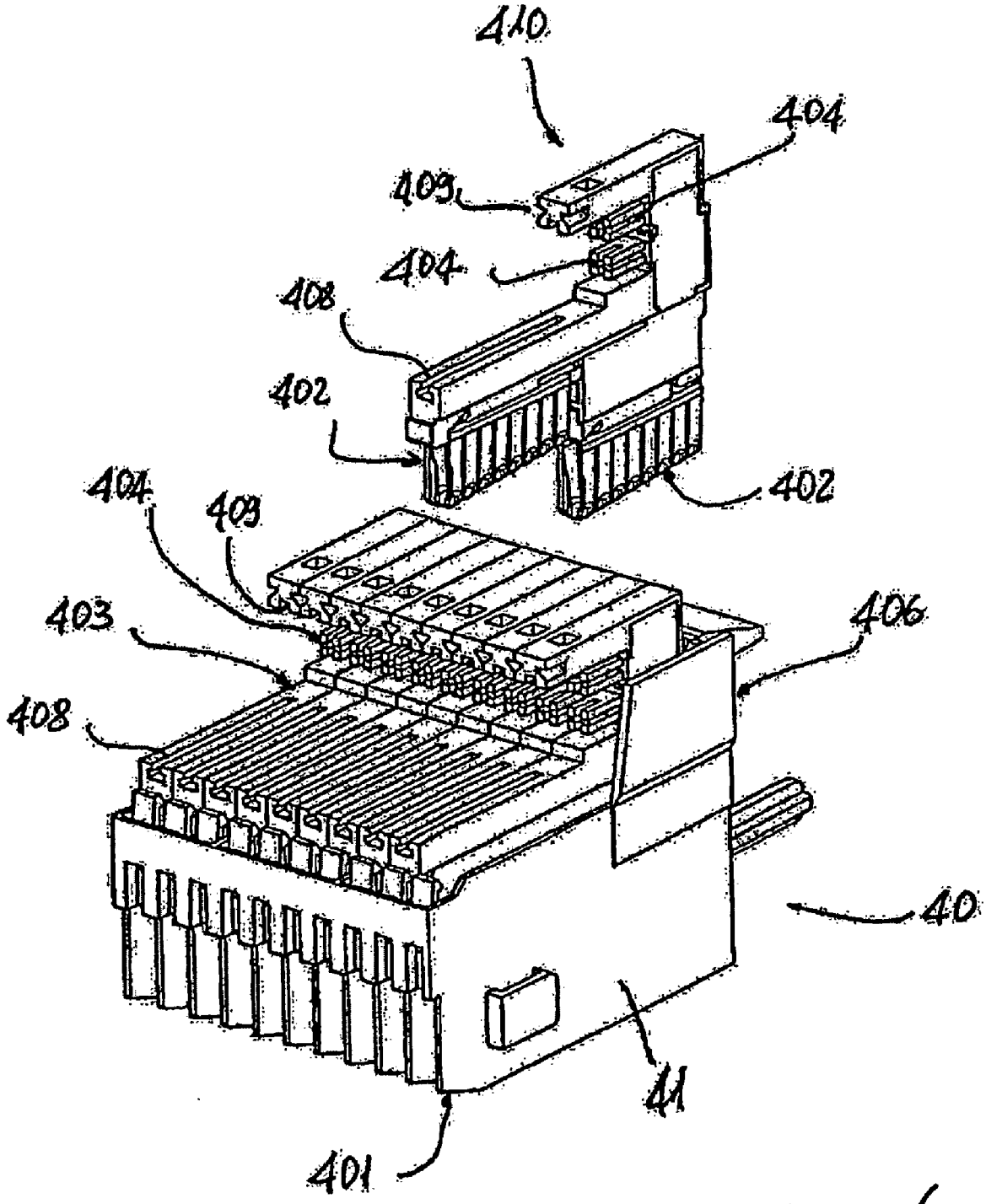
FIG. 6 is a perspective view of a second detail of a connection device according to the invention.
Figure 9:
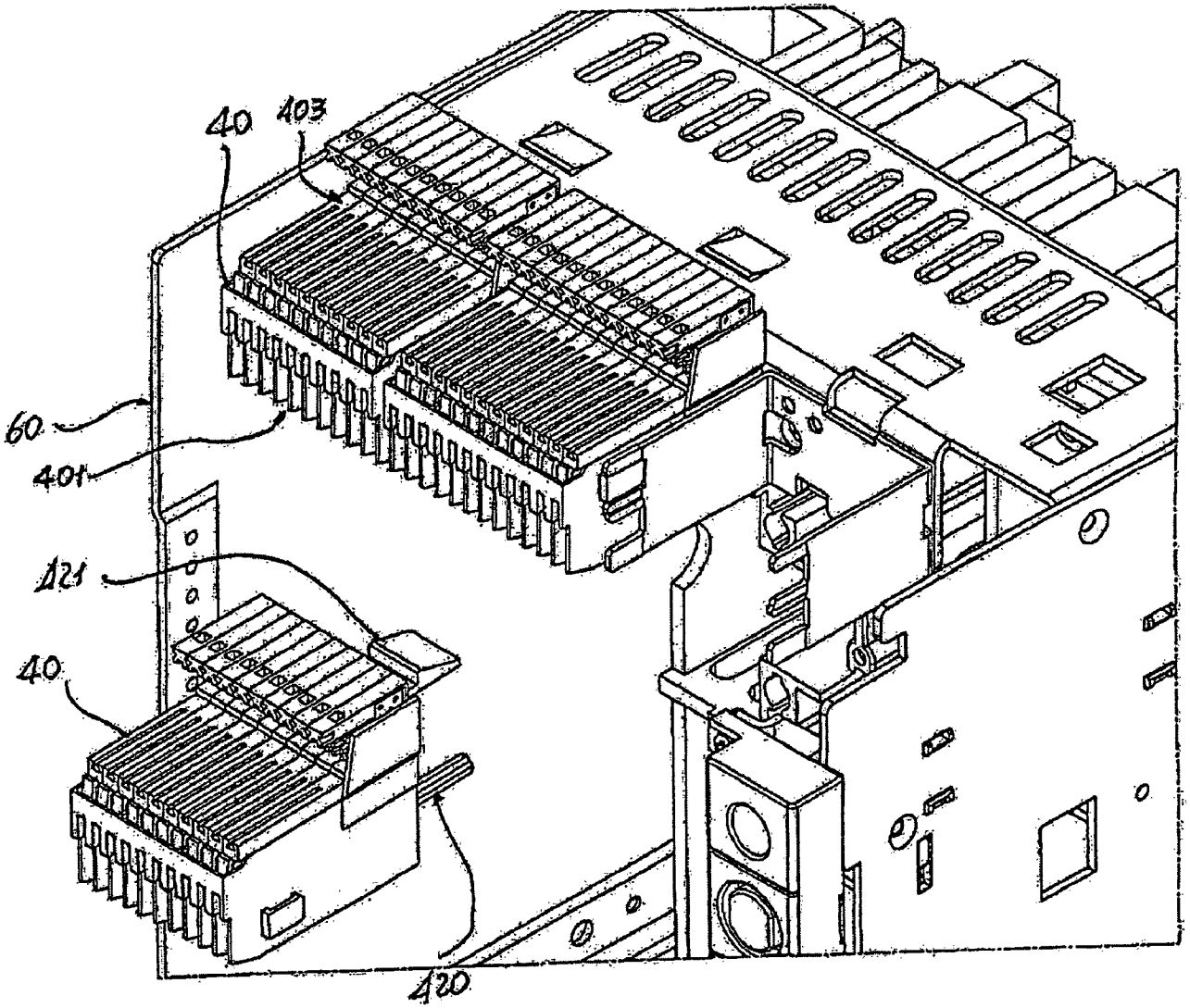
FIG. 9 is a partial perspective view which illustrates installation of the item of FIG. 6 on the supporting structure of a low-voltage switch in the withdrawable version.

Preferably, with reference to FIGS. 6 and 9, the second means of interposition 40 comprise a body 41 having a fourth coupling surface 401 mated with the second surface 302 of the first means of interposition 30. Set on said fourth surface 401 are third contact means 402 for electrical connection to the second contact means 303 of said first means of interposition 30.

Preferably, said second surface is furrowed by grooves, set inside which are the third contact means 402, which are preferably aligned in two rows on two different planes, so as to intercept conveniently the two corresponding rows of contact elements 303 which extend from said second surface 302.

The body 41 moreover comprises a fifth surface 403 of coupling with said one or more cable clamps 20; set on said fifth surface 403 are fourth contact means 404, which serve as electrical connection to said one or more cable clamps 20 and are electrically connected to said third contact means 402.

The fifth surface 403 can advantageously be shaped like a hook with two substantially parallel branches 408 and 409 of different lengths radiused by a branch that is substantially perpendicular to them, there being set on said radiusing branch the contact means 404. Preferably, the branches 408 and 409 have coupling means, for instance grooves, for coupling with the cable clamp 20, for example via its ribbings 215 and/or 219.

In addition, the second means of interposition 40 can advantageously comprise at least one sixth surface 406 for coupling with a supporting structure 60. On this sixth surface there are preferably positioned means of mechanical coupling, such as for instance guiding systems for insertion 420 and snap-action plug-in systems 421.

Preferably, the second means of interposition 40 have a modular structure and comprise a plurality of modular contact elements 410. In this way it is possible, with a relatively limited number of components, to equip switches of different types.

With reference to FIG. 9, the second means of interposition 40 are fixed to a supporting structure 60, which, once the operation is terminated, has a structure provided with a plurality of seats 403 designed to couple with the cable clamps 20.

The switch 1 is then inserted (FIG. 10) within the supporting structure so that electrical, and preferably also mechanical, coupling is guaranteed between the first means of interposition 30 and the second means of interposition 40, through the surfaces 302 and 401 and through the coupling of the second contact means 303 and third contact means 402. For this purpose; it is preferable that said second contact means 303 and third contact means 402 should be sliding contact means, whilst said first contact means 305 and fourth contact means 404 can conveniently be plug-in contact means.

Figure 10:
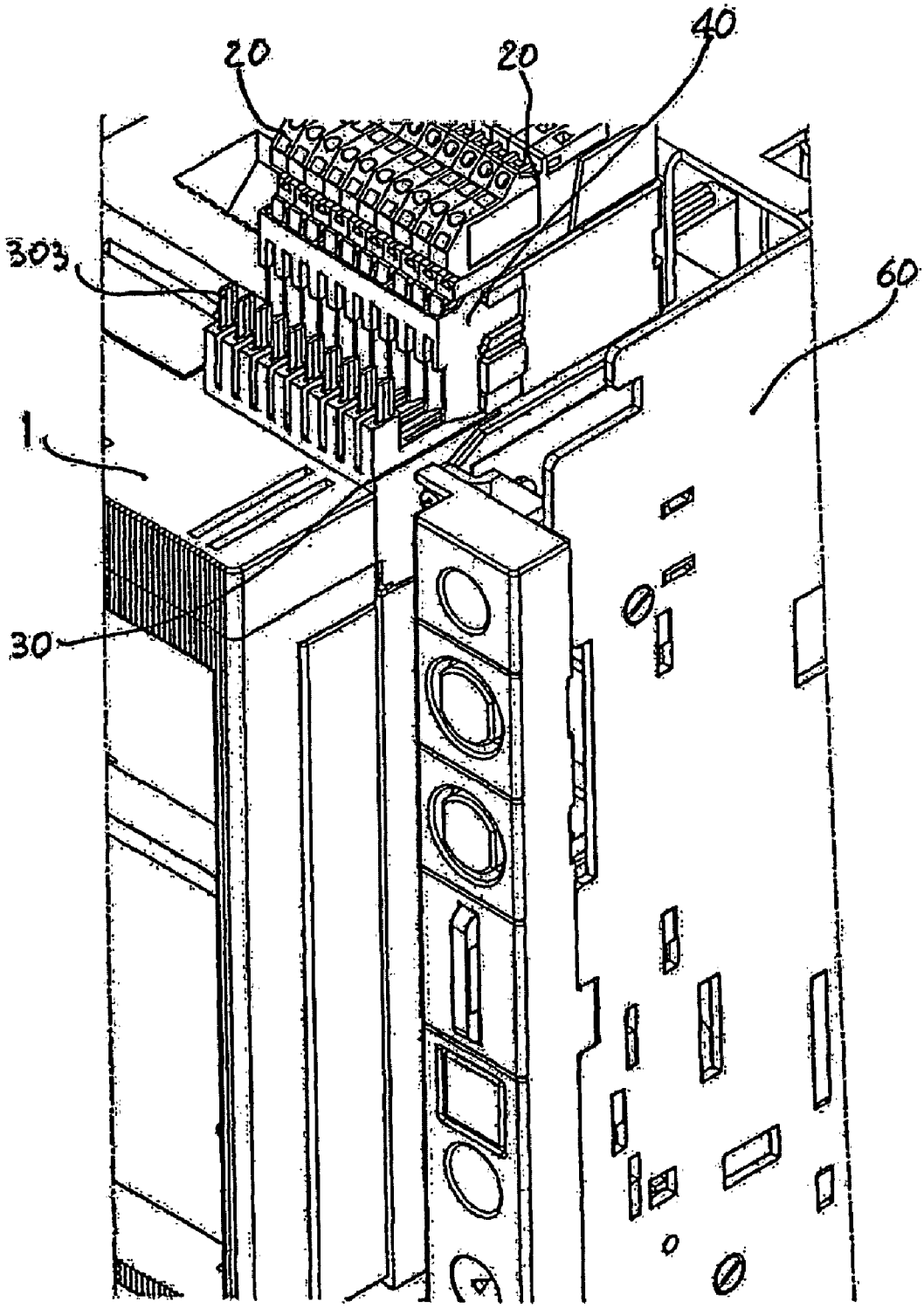
FIG. 10 illustrates an intermediate step of installation of a connection device according to the invention in a low-voltage switch, in the withdrawable version.

As may be seen from FIGS. 5, 6, and 10, the surfaces 302 and 401 preferably have grooves that are geometrically conjugate or mated and that enable coupling between the first and second means of interposition 30 and 40, with the second contact means 303 that enter the grooves of the surface 401 of the second means of interposition 40, so coupling with the third contact means 402 present within said grooves of said surface 401.

According to a particularly preferred embodiment, the fifth coupling surface 403 and the fourth contact means 404 substantially replicate geometrically and electrically said first terminal board 10. In this way, once the switch 1 has been inserted in the supporting structure 60, there becomes accessible from outside, via said first and second means of interposition 30 and 40, the connection to the terminals of the terminal board 10 and hence to the accessories and devices housed inside the body of the switch.

Figure 11:
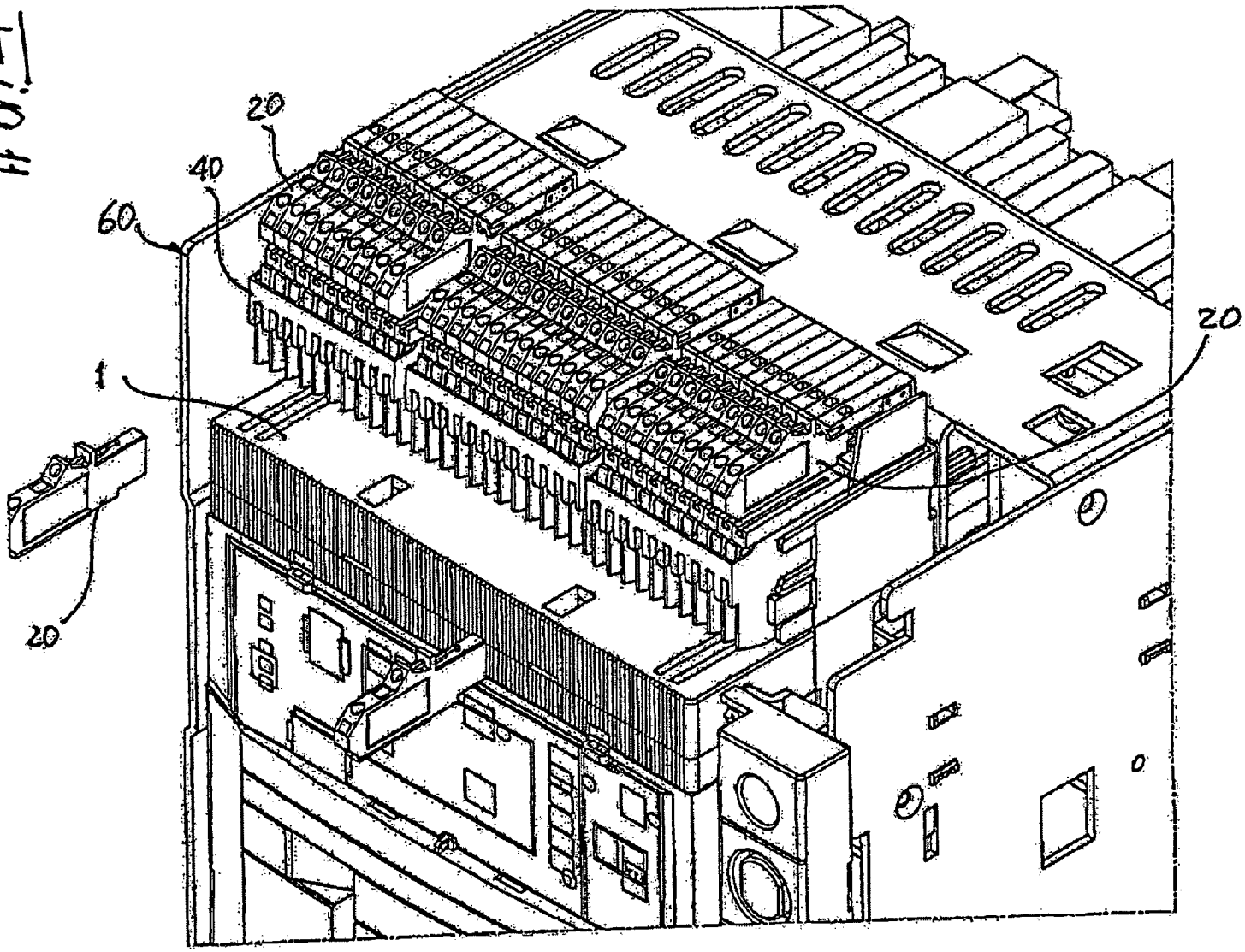
FIG. 11 illustrates the final step, of the installation of a connection device according to the invention in a low-voltage switch in the withdrawable version.

With reference to FIG. 11, the same cable clamps 20 used in the switch in the fixed version can then be inserted in the terminal board 403, rendering possible immediate connection to the accessories and devices within the body 50 of the switch in the withdrawable version.

A further aspect of the present invention is constituted in fact by a withdrawable low-voltage switch 1, which comprises a body 50 containing one or more fixed contacts and corresponding mobile contacts, control members, one or more kinematic chains, and a supporting structure 60, in which, said body can be inserted and from which it can be withdrawn; the switch according to the invention is characterized in that set on said body 50 is a first terminal board 10 comprising a plurality of terminals for electrical connection to one or more devices or accessories inside said switch 1. First means of interposition 30 are positioned on said body 50 and are mechanically and electrically connected to said first terminal board 10; second means of interposition 40 are moreover positioned on said supporting structure 60 and are electrically connected to said first means of interposition 30.

The second means of interposition 40 moreover have a second terminal board 403 comprising a plurality of terminals for, connection to one or more cable clamps 20 for connection between said terminals and one or more corresponding connection cables, said second terminal board 403 substantially replicating geometrically and electrically the first terminal board 10.

On the basis of the above description, it has been seen how the connection device according to the invention, as well as switches comprising said device, achieve the pre-set purposes.

The presence of the terminal board makes it in fact possible to concentrate in a single area the interface between accessories and devices inside the switch and further devices on the outside thereof, thus reducing considerably the need for wiring.

The particular morphology of the cable clamps moreover considerably facilitates connection between the terminal board itself and the cables for connection to the outside world.

Furthermore, a considerable advantage is guaranteed in that, through the first and second means of interposition, a switch in the withdrawable version is found to have the same connection interface as one in the fixed version, thus reducing the number of components necessary for equipping the two versions or passing from one version to the other, as well as limiting considerably the possibility of errors on the part of operators in the wiring stage.

On the basis of the description provided, other characteristics, modifications or improvements are possible and evident to the average person skilled in the branch.

Said characteristics, modifications and improvements are hence to be considered as forming part of the present invention. In practice, the materials used, as well as the contingent dimensions and shapes, may be any whatsoever according to the requirements and the state of the art.

The invention claimed is:

1. A connection device for low-voltage switches, comprising:

a first terminal board positioned on a switch and provided with a plurality of terminals for electrical connection to one or more devices or accessories inside said switch; and one or more cable clamps for connection between said terminals and one or more corresponding connection cables, said connection device being characterized in that it comprises first means of interposition comprising a body having a first surface shaped to couple geometrically with said first terminal board and provided with first contact means for electrical connection to the terminals of said first terminal board, and a second surface, on which second contact means are set, electrically connected to said first contact means, said second contact means substantially replicating geometrically and electrically said first terminal board.

2. The connection device according to claim 1, characterized in that said cable clamp comprises a shaped body having a first end shaped to couple mechanically and electrically with said first terminal board, said shaped body having a first opening for insertion of a first connection cable, conductive means being positioned within said shaped body for electrical connection between said terminals of said terminal board and said connection cable.

3. The connection device according to claim 2, characterized in that the shaped body of said cable clamp comprises two half-shells geometrically mated and provided with reciprocal mechanical coupling means.

4. The connection device according to claim 2, characterized in that said shaped body has a second opening for insertion of a second of said connection cables.

5. The connection device according to claim 2, characterized in that said shaped body has, in a position corresponding to said first end, a third opening and a fourth opening for insertion of a first terminal and a second terminal of said first terminal board.

6. The connection device according to claim 4, characterized in that it comprises first conductive means, for connection between said first terminal and said first cable, and second conductive means, for connection between said second terminal and said second cable.

7. The connection device according to claim 2, characterized in that it comprises elastic means for clamping and release of said connection cables, one or more holes being provided on said shaped body to guarantee access to said elastic means for clamping and release.

8. The connection device according to claim 1, characterized in that it comprises second means of interposition between said first terminal board of said switch and said one or more cable clamps.

9. The connection device according to claim 1, characterized in that said first means of interposition comprise at least one third surface for coupling with said switch.

10. The connection device according to claim 8, characterized in that said second means of interposition comprise a body having a fourth surface for coupling with said second surface of said first means of interposition, third contact means being set on said fourth surface for electrical connection to the second contact means of said first means of interposition, and a fifth surface for coupling with said one or more cable clamps, fourth contact means for electrical connection to said one or more cable clamps being set on said fifth surface and being electrically connected to said third contact means.

11. The connection device according to claim 10, characterized in that said second means of interposition comprise at least one sixth surface for coupling with a supporting structure.

12. The connection device according to claim 10, characterized in that said second contact means and third contact means are sliding contact means and said first contact means and fourth contact means are plug-in contact means.

13. The connection device according to claim 10, characterized in that said fifth coupling surface and said fourth contact means substantially replicate geometrically and electrically said first terminal board.

14. The connection device according to claim 10, characterized in that said second means of interposition comprise a plurality of modular contact elements.

15. A low-voltage switch comprising a connection device according to claim 1.

16. The low-voltage switch comprising a body containing one or more fixed contacts and corresponding mobile contacts, one or more kinematic chains, characterized in that it comprises a connection device according to claim 1.

17. The low-voltage switch according to claim 16, characterized in that it comprises a device for housing and connection of accessories positioned within said body, said device being electrically connected to said first terminal board.

18. The low-voltage switch according to claim 16, characterized in that said device for housing and connection comprises a bus with integrated wiring for connection.

19. The low-voltage switch comprising a body containing one or more fixed contacts and corresponding mobile contacts, one or more kinematic chains, a supporting structure, in which said body can be inserted and from which it can be withdrawn, said switch being characterized in that it comprises a connection device according to claim 7.

20. A withdrawable low-voltage switch comprising a body containing one or more fixed contacts and corresponding mobile contacts, one or more kinematic chains, a supporting structure, in which said body can be inserted and from which it can be withdrawn, characterized in that set on said body is a first terminal board comprising a plurality of terminals for electrical connection to one or more devices or accessories inside said switch, first means of interposition being located on said body and being mechanically and electrically connected to said first terminal board, second means of interposition being located on said supporting structure and being electrically connected to said first means of interposition, said second means of interposition moreover having a second terminal board comprising a plurality of terminals for connection to one or more cable clamps for connection between said terminals and one or more corresponding connection cables, said second terminal board substantially replicating geometrically and electrically said first terminal board.

* * * * *